US010279343B2

(12) United States Patent
Vergauwe et al.

(10) Patent No.: US 10,279,343 B2
(45) Date of Patent: May 7, 2019

(54) TRANSFER DEVICE OF BIOLOGICAL MATERIAL

(71) Applicant: Biocartis NV, Mechelen (BE)

(72) Inventors: Nicolas Vergauwe, Borgloon (BE); Thierry Tollenboom, Wilrijk (BE)

(73) Assignee: Biocartis NV, Mechelen (BE)

( * ) Notice: Subject to any disclaimer, the term of this patent is extended or adjusted under 35 U.S.C. 154(b) by 212 days.

(21) Appl. No.: 15/030,741

(22) PCT Filed: Oct. 24, 2014

(86) PCT No.: PCT/EP2014/002887
§ 371 (c)(1),
(2) Date: Apr. 20, 2016

(87) PCT Pub. No.: WO2015/062714
PCT Pub. Date: May 7, 2015

(65) Prior Publication Data

US 2016/0263570 A1 Sep. 15, 2016

(30) Foreign Application Priority Data

Oct. 28, 2013 (EP) ..... 13190430

(51) Int. Cl.
*B01L 3/02* (2006.01)
*B01L 3/00* (2006.01)

(52) U.S. Cl.
CPC ..... *B01L 3/0296* (2013.01); *B01L 3/0293* (2013.01); *B01L 3/5025* (2013.01);
(Continued)

(58) Field of Classification Search
USPC ..... 422/570, 512, 568, 544, 546, 558
See application file for complete search history.

(56) References Cited

U.S. PATENT DOCUMENTS 6,887,429 B1 * 5/2005 Marshall ..... G01N 35/0092 422/50
7,427,379 B1 * 9/2008 Hagerlid ..... B01L 3/0293 422/404

(Continued)

FOREIGN PATENT DOCUMENTS

EP 1 525 918 4/2005 ..... B01L 3/00
EP 1 525 918 A2 4/2005

(Continued)

OTHER PUBLICATIONS

International Search Report from corresponding International Patent Application No. PCT/EP2014/002887, dated May 11, 2015.

(Continued)

*Primary Examiner* — Brian R Gordon
(74) *Attorney, Agent, or Firm* — Kusner & Jaffe

(57) ABSTRACT

A transfer device for the contamination free transfer of biological material from a sealed chamber to a recipient. The transfer device includes a support having a first docking area and a second docking area. The first docking area has at least one inlet port, each inlet port creating a fluid connection with one sealed chamber. The second docking area has at least one outlet port, each outlet port creating a fluid connection with a recipient. The first docking area further includes a piercing element designed for piercing a sealing element of a sealed chamber in order to allow, together with at least one inlet port, a fluid connection between a pierced sealed chamber and the inlet port, to allow a contamination free transfer of the biological material from the pierced sealed chamber to at least one recipient.

17 Claims, 4 Drawing Sheets

(52) U.S. Cl.
CPC ..... *B01L 3/50825* (2013.01); *B01L 3/563* (2013.01); *B01L 2200/026* (2013.01); *B01L 2200/0631* (2013.01); *B01L 2300/044* (2013.01); *B01L 2300/046* (2013.01); *B01L 2300/0672* (2013.01); *B01L 2300/0803* (2013.01); *B01L 2300/0832* (2013.01); *B01L 2400/0409* (2013.01); *B01L 2400/0487* (2013.01); *B01L 2400/0683* (2013.01)

(56) References Cited

U.S. PATENT DOCUMENTS

| | | | | |
|---|---|---|---|---|
| 8,372,343 | B2 | 2/2013 | Goldstein | |
| 9,857,383 | B2 | 1/2018 | Goldstein | |
| 2003/0109031 | A1 | 6/2003 | Chafin et al. | |
| 2007/0026439 | A1 | 2/2007 | Faulstich et al. | 435/6 |
| 2008/0199900 | A1 | 8/2008 | Signore et al. | |
| 2011/0212517 | A1 | 9/2011 | Dahm | 435/306.1 |

FOREIGN PATENT DOCUMENTS

| | | | | |
|---|---|---|---|---|
| EP | 1 614 464 | A1 | 1/2006 | |
| EP | 1 773 496 | B1 | 10/2010 | |
| JP | 2005-508198 | A | 3/2005 | |
| JP | 2009-058386 | A | 3/2009 | |
| JP | 2011-506933 | A | 3/2011 | |
| WO | WO-03/040413 | A1 | 5/2003 | |
| WO | WO-2006/013599 | A1 | 2/2006 | |
| WO | WO2009/072332 | A1 | 6/2009 | |
| WO | WO-2009/072332 | A1 | 6/2009 | |
| WO | WO-2009/073851 | A1 | 6/2009 | |
| WO | WO 2013/072698 | | 5/2013 | B65D 41/20 |

OTHER PUBLICATIONS

Hui Liu et al., "Fully Integrated Miniature Device for Automated Gene Expression DNA Microarray Processing," *Analytical Chemistry* (2006), vol. 78, No. 6., pp. 1980-1986.

* cited by examiner

TRANSFER DEVICE OF BIOLOGICAL MATERIAL

FIELD OF THE INVENTION

The present invention relates to a transfer device for the contamination free transfer of at least a biological material from at least a sealed chamber to at least a recipient. The present invention also relates to a recipient designed for being connected to the transfer device. Furthermore, the present invention relates to a kit for the contamination free transfer of at least a biological material. In the last few years, the personalized medicine has become a reality with new diagnostic cartridges that offer wide variety of assays, crucial to assist the physician in its choice of the most appropriate treatment.

BACKGROUND OF THE INVENTION

An increasing number of assays require amplification of DNA sequences to determine the presence or absence of certain alterations in a biological sample and diagnostic cartridges are often dedicated to perform such kind of assays. One of such diagnostic cartridges has been developed by the applicant. The applicant's diagnostic cartridge offers a unique value proposition with respect to sophisticated molecular diagnostic assays that show disruptive user-friendliness, turn-around time, quantification, e-connectivity, and level of multiplex testing.

Molecular diagnostic cartridges capable of performing DNA amplification are usually designed and conceptualized as self-contained and fully closed systems to prevent any type of cross-contamination. Therefore, no openings are present in such diagnostic cartridges from where processed samples or nucleic acid materials can be recovered, the final destination of the nucleic acid materials in the diagnostic cartridges being often sealed chambers.

Although the panel of possible assays increases rapidly, each existing diagnostic cartridge is currently designed to perform only one type of analysis without further downstream analysis possibility. However, in some instances, a deeper understanding of the origin of a disease may be required.

Alternatively, in some cases, patient sample is precious and present in only small amounts. When a plurality of assays is required to understand the disease origin, not enough sample may be present for further analysis. The existing diagnostic cartridges do not provide a convenient solution when further analysis are required. Therefore a solution is needed that would allow such further downstream analysis.

The present invention aims to remedy all or part of the disadvantages mentioned above.

SUMMARY OF THE INVENTION

The present invention hereto provides a transfer device for the contamination free transfer of at least a biological material from at least a sealed chamber, to at least a recipient. The transferred biological material or leftovers from the sample (eg isolated nucleic acid material that is obtained as part of the molecular analysis) can be recovered for additional testing.

The present invention fulfills these objectives by providing a transfer device for the contamination free transfer of at least a biological material from at least a sealed chamber, sealed by sealing means, to at least a recipient, the transfer device comprising a support that comprises a first docking area and a second docking area, said first docking area comprising at least an inlet port, each inlet port being designed for creating a fluid connection with one sealed chamber, and said second docking area comprising at least an outlet port, each outlet port being designed for creating a fluid connection with a recipient, at least one inlet port being in fluid connection with at least one outlet port, the transfer device further comprising piercing means being designed for piercing the sealing means of at least a sealed chamber in order to allow, together with at least an inlet port, at least a fluid connection between a pierced sealed chamber and said inlet port, to allow a contamination free transfer of the biological material from the pierced sealed chamber to at least a recipient.

The invention also relates to a recipient being designed for being connected to a transfer device according to the present invention, the recipient comprising a vial with a sealed opening, the vial further comprising docking means for cooperating with the second docking area of the transfer device, said docking means comprising at least a sealable channel designed for creating a fluid connection between the recipient and the transfer device.

Moreover, the invention concerns a kit for the contamination free transfer of at least a biological material from at least a sealed chamber to at least a recipient, the kit comprising at least a transfer device according to the present invention and at least a recipient designed for being connected to said transfer device.

Furthermore, the invention also concerns a kit for the contamination free transfer of at least a biological material from at least a sealed chamber to at least a recipient, the kit comprising at least a transfer device according to the present invention and at least a recipient according to the present invention.

Thus, the present invention solves the problem by providing a transfer device that allows transferring a biological material contained in a sealed chamber, for example of a diagnostic cartridge, into at least a recipient which allows further downstream analysis of said biological material. The transfer from the sealed chamber to the transfer device is done under contamination free conditions thanks to the collaboration of the piercing means with at least an inlet port of the transfer device according to the invention. Once positioned into the transfer device, the biological material is then transferred into the recipient via a fluid connection between the inlet port and one outlet port, again under contamination free conditions. Thus the transfer device allows further analysis of the biological material that was not possible in the sealed chamber. The transfer device extends the scope of the possible analysis that can be performed on the biological material.

According to an embodiment, the first docking area and/or the second docking area are respectively designed for being docked with a sealed chamber and/or with a recipient. Thus, advantageously, the first area and/or the second area are designed for allowing a contamination free transfer of the biological material.

In an embodiment, the first docking area further comprises a slot for accommodating a platform comprising at least one sealed chamber.

According to an embodiment, the transfer device further comprises at least an additional container, each additional container being designed for being placed in fluid connection with one pierced sealed chamber in order to transfer a fluid contained in each additional container to said pierced sealed chamber. Thus, when the additional container is in fluid connection with the sealed chamber, the fluid assists the transfer of the biological material from the sealed chamber to the recipient.

In an embodiment, the piercing means initiate the transfer of the fluid from each additional container to said pierced sealed chamber.

According to an embodiment, the transfer device further comprises fluid displacement means for displacing a liquid contained in one sealed chamber when said sealed chamber is in fluid connection with an inlet port, towards at least an outlet port. Thus, the fluid displacement means facilitate the displacement of the biological material between an inlet port and an outlet port.

In an embodiment, each inlet port and each outlet port are respectively in fluid connection with one outlet port and one inlet port. Thus, a plurality of biological materials can be transferred from a plurality of sealed chambers into their respective recipients.

According to an embodiment, the transfer device is further designed for transferring a biological material, obtained by PCR amplification, from a PCR sealed chamber.

According to the invention, the transfer device is particularly suitable to transfer biological material containing extracted nucleic acid material or proteins.

In an embodiment, the piercing means are designed for piercing at least a foil that seals a sealed chamber.

According to an embodiment, the transfer device further comprises purification means for purifying the transferred biological material.

In an embodiment, said docking means are designed for making the recipient removable. Thus when the transfer of the biological material into the recipient is completed, the recipient can be removed from the transfer device, under contamination free conditions, and the biological material that it contains can be involved in further analysis.

BRIEF DESCRIPTION OF THE DRAWINGS

The present invention is further illustrated by the following detailed description set forth in view of the appended drawings, which represent an exemplary and explanatory embodiment of a transfer device and a recipient according to the present invention, wherein.

DETAILED DESCRIPTION OF THE INVENTION

Figure 1:
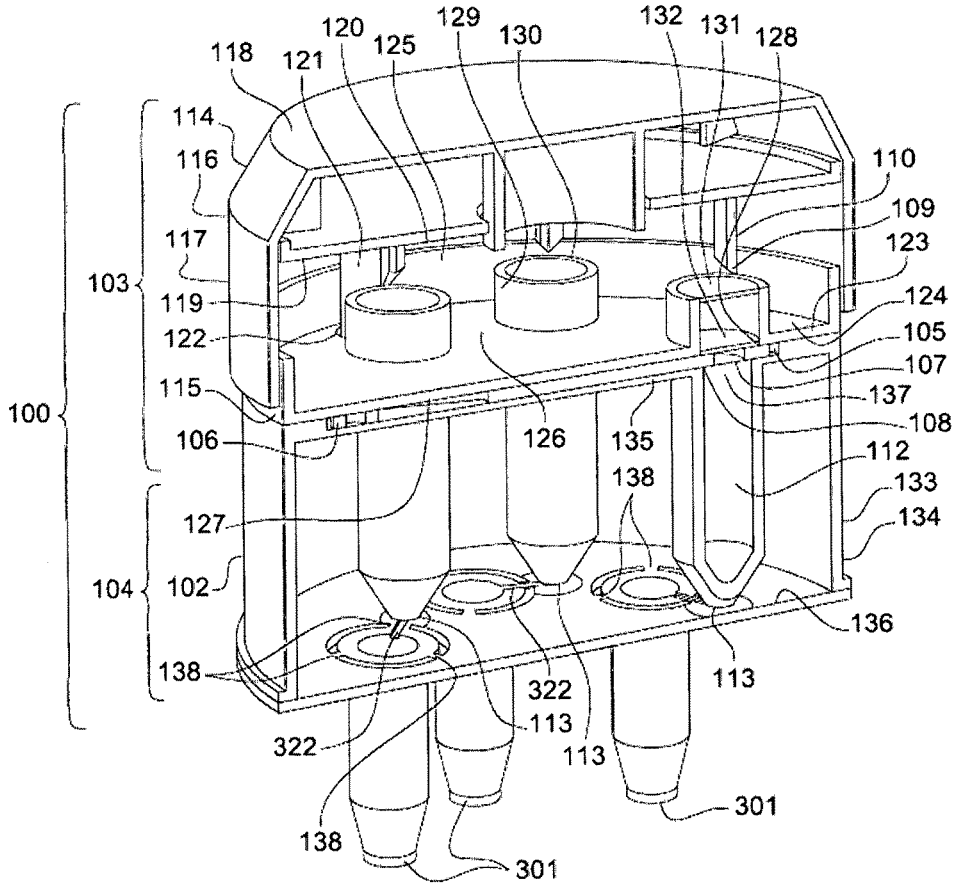
FIG. 1 is a schematic cross section view of a first embodiment of a transfer device according to the present invention.
Figure 2:
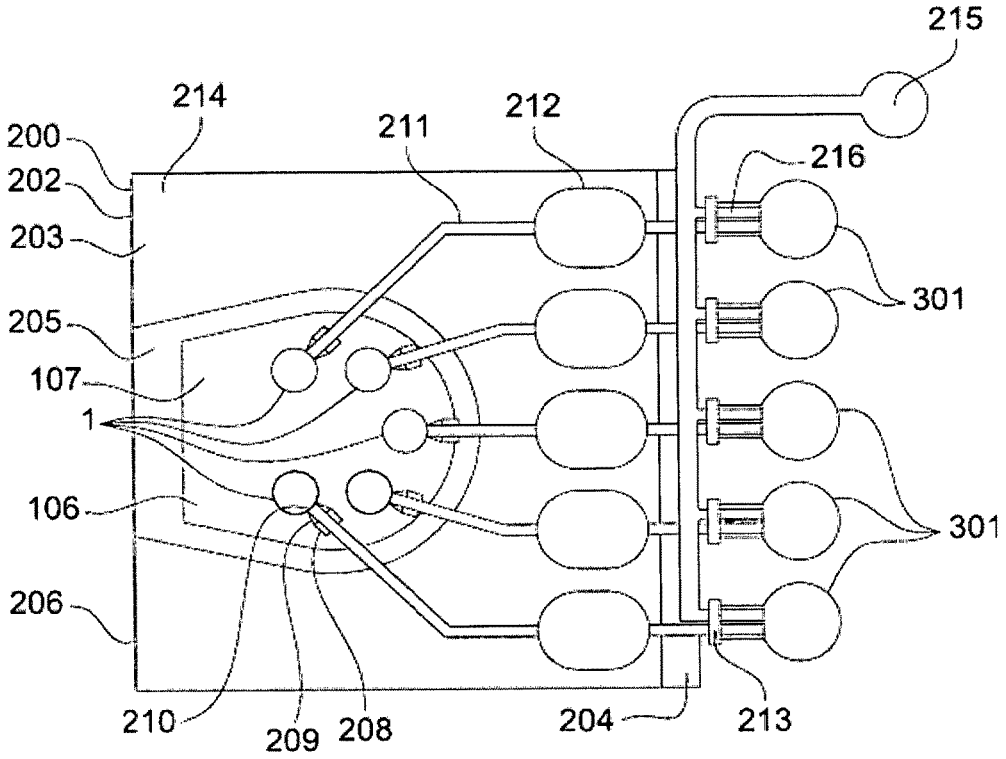
FIG. 2 is a schematic bottom view of a second embodiment of a transfer device according to the present invention.

A transfer device 100, 200 according to the present invention, schematically illustrated in FIGS. 1 and 2, aims to transfer at least a biological material from at least a sealed chamber 1 to at least a recipient 301.

Figure 4:
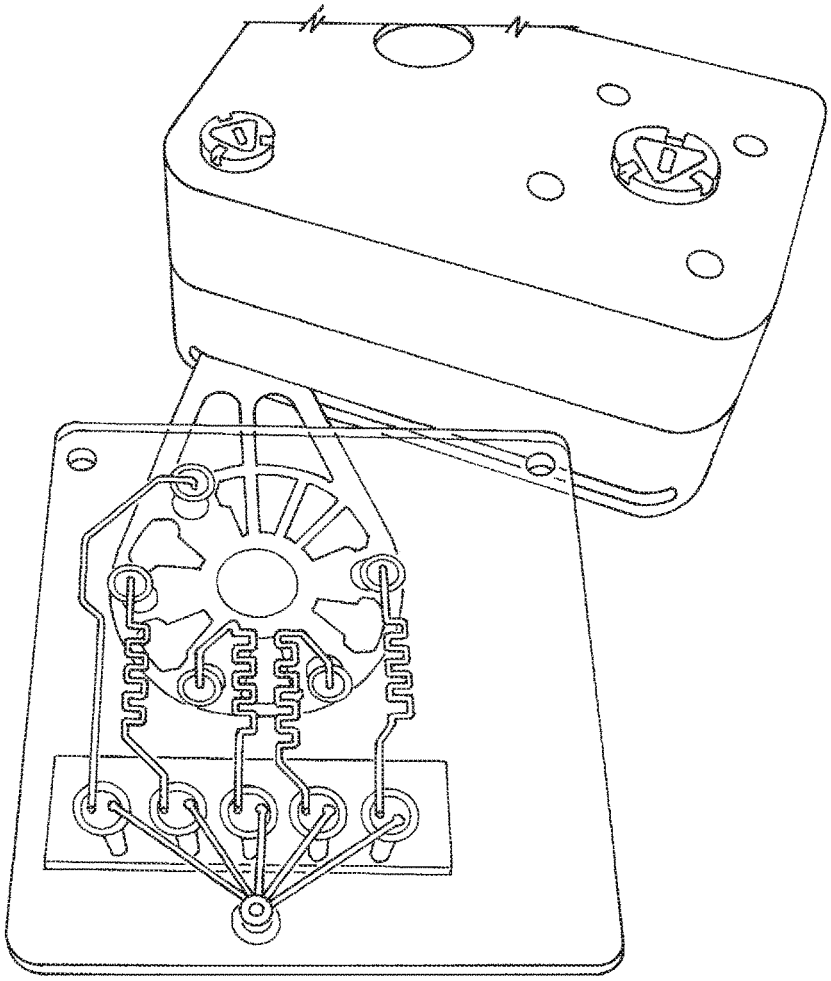
FIG. 4 is a picture of a working embodiment of a transfer device according to the present invention.

The biological material can be obtained, for example, within a diagnostic cartridge. FIG. 4 illustrates a diagnostic cartridge from which a biological material from at least a sealed chamber, sealed by sealing means, is moved to at least a recipient with a transfer device, Within said diagnostic cartridge, a biological sample to be analyzed has been solubilized, lysed and the resulting solution containing DNA fragments was divided into a plurality of chambers of a PCR disk of said diagnostic cartridge, each chamber containing the required reagent for performing a PCR reaction. Then, the chambers were sealed and PCR reactions were initiated in said sealed chambers 1 to generate amplicons. In other instances, the sealed chamber 1 may comprise other types of biological material such as proteins for example. In the present example, the diagnostic cartridge has been designed for generating fluorescent signals indicative of the presence of the amplicons generated in each sealed chambers 1 during the PCR reactions. In other instances, different methods of detections may be used to determine the presence or absence of a target molecule in the biological material. In case further information regarding the amplicons or the biological sample are required, the transfer device 100, 200 according to the invention is used to transfer the biological material contained in the sealed chambers 1 to the recipient 301.

The transfer device 100, 200 according the present invention comprises a support 102, 202 comprising a first docking area 103, 203 and a second docking area 104, 204. The first docking area 103, 203 is designed for docking at least the sealed chamber 1. To that end, the first docking area 103, 203 comprises a slot 105, 205 for accommodating a platform 106, for example the PCR disk, containing the plurality of sealed chambers 1. In the example represented in the figures, the platform 106 comprises five sealed chambers 1. The platform 106 was, as described above, initially attached to a diagnostic cartridge, was sealed and then was broken off thereof after the completion of the PCR reactions. The platform 106 has a shape of a disk and the sealed chambers 1 are formed of through-holes in the thickness of the platform 106, each face of the platform 106 being covered by a foil 107 to delineate and to close the sealed chambers 1. Sealable channels, not shown in the figures, are carved in the platform 106 to allow the filling of the sealed chambers 1. Said channels are sealed off before the PCR reactions take place. The slot 105, 205 of the first docking area 103, 203 has a shape that is complementary to the platform 106 in order to accommodate the platform 106 and prevent any leakage of fluid.

The first docking area 103, 203 further comprises at least an inlet port 108, 208, each inlet port 108, 208 being designed for creating a fluid connection with one sealed chamber 1. In the present cases, the first docking area 103, 203 comprises five inlet ports 108, 208 designed for being placed in fluid connection with the five sealed chambers 1 of the platform 106, each sealed chamber 1 being in fluid connection with only one inlet port 108, 208. Furthermore, the transfer device 100, 200 comprises piercing means designed for piercing the sealing means, the foil 107, of the sealed chambers 1 in order to allow, together with at least an inlet port 108, 208 the fluid connection between the sealed chamber 1 and one inlet port 108, 208. When the sealed chambers 1 of the platform 106 are docked to the first docking area 103, 203, the piercing means pierce the foil 107 of the sealed chamber 1 so that the inlet port 108, 208 is placed in fluid connection with the sealed chamber 1. In the present embodiments, the piercing means comprise sharp tips 109, 209 capable of piercing the foil 107 of the sealed chambers 1 and comprise a longitudinal groove 110, 210 extending along each tips 109, 209 that permits the displacement of the biological material contained in the sealed chamber 1. To that end, each longitudinal groove 110, 210 is designed for being in fluid connection with inlet port 108, 208.

Advantageously, each inlet port 108, 208 is in fluid connection with a purification chamber 112, 212. The purification chamber 112, 212 comprises purification means, such as a Sephadex G25 (not shown, CAS Number 9041-35-4). Thus, the purification means are able to purify the biological material forced through the purification means.

When the platform 106 is docked in the first docking area 103, 203, the piercing means pierce the foil 107 of each sealed chamber 1 and the corresponding inlet port 108, 208, comprising for example a gasket (not represented), ensures a watertight fluid connection between the pierced sealed chamber 1 and the transfer device 100, 200. Then, the biological material contained in said pierced chamber 1 can be transferred into the recipient 301 docked to the second docking area 104, 204 and connected to a corresponding outlet port 113, 213. As a result, the transfer device 100, 200 permits to transfer the biological material contained in each sealed chamber 1 to one corresponding recipient 301.

The transfer device 100 according to a first embodiment is represented in FIG. 1. In this embodiment, the transfer device comprises three components, a cap 114, well plate 115, a piercing plate 120 and the support 102. Moreover, the cap 114, the well plate 115 and the piercing plate 120 are designed for cooperating together to form a lid 139, said lid 139 being designed for being coupled to the support 102.

The cap 114 is designed for joining the well plate 115 and the piercing plate 120 to the support 102. The cap 114 is formed of a conical bottomed cylinder 116 delineated by a cylindrical surface 117 and two major surfaces, a first major surface 118 and a second major surface 119 opposite to the first major surface 118. The first major surface 118 is designed for being contacted by the user to join the cap 114, the piercing plate 120 and the well plate 115 and to the support 102.

The piercing plate 120 is shaped to be accommodated into the cap 114, said piercing plate 120 being designed for being placed between the cap 114 and the well plate 115, opposite the second major surface 119 of the cap 114. Said piercing plate 120 comprises the sharp tips 109, said sharp tips 109 extending from the piercing plate 120 in a direction parallel to the axis of the cap 114. The cap 114 further comprises a pin 121 extending from the second major surface 119 of the cap 114 in the same direction as the sharped tip 109. The pin 121 locks the position of the piercing plate 120 with respect to the well plate 115 and to the support 102. To that end, the pin 121 is designed for being received in two holes, a first hole 122 manufactured in the well plate 115 and a second hole (not shown) manufactured in the support 102.

The well plate 115 comprises a disk 123 with a planar surface 124 delimitated by a circular wall 125. The disk 123 comprises two faces, the cap face 126 and the support face 127 to be placed respectively opposite the piercing plate 120 and the support 102. The well plate 115 is designed for accommodating part of the platform 106 when the platform 106 is docked to the support 102, in order to maintain said platform 106 between the well plate 115 and the support 102. The well plate 115 is pierced with five traversing holes 128, each hole 128 being positioned in order to be placed opposite one sealed chamber 1 of the platform 106 and one shaped tip 109 of the cap 114. The well plate 115 further comprises five additional containers 129 formed by a tube 130, each tube 130 extending from one traversing hole 128. Each tube 130 is closed by a first sealed opening 131 opposite the piercing plate 120 and a second sealed opening 132 opposite the inlet port 108. The additional container 129 contains a washing solution for washing the pierced sealed chamber 1.

The support 102 has the shape of a cylinder 133 delineated by a cylindrical surface 134 and two main surfaces, a first main surface 135 and a second main surface 136 opposite to the first main surface 135, said first main surface 135 being designed for being placed opposite the well plate 115. The first docking area 103 comprises the first main surface 135 whereas the second docking area 104 comprises the second main surface 136. The first docking area 103 further comprises the slot 105 shaped to accommodate the platform 106 containing the sealed chambers 1, said slot 105 being formed by a recess in the first main surface 135. The support 102 further comprises the inlet port 108. The inlet port 108 are formed of circular orifice 137 manufactured in the support 102 so as to be placed opposite to the corresponding sealed chamber 1 and to the corresponding second sealed opening 132 of one of the corresponding tube 130.

When the well plate 115 is accommodated in the cap 114 comprising the piercing plate 120 to form the lid 139 and the pin 121 is received in the first hole 122, each sharp tip 109 is capable of piercing successively the first and second sealed opening 131, 132 of one additional container 129 and the foil 107 of one sealed chamber 1 to create a fluid connection between one additional container 131, one sealed chamber 1 and one inlet port 108.

The support 102 also comprises the purification chambers 112, shaped as conical tube extending along the axis of the cylinder 133 between the first and the second main surfaces 135, 136. Each purification chamber 112 leads at one side to the inlet port 108 and at the opposite side to one outlet port 113. For example, the purifications chambers 112 can be filled with a material and/or filters that are designed for purifying the biological material. Each outlet port 113 is designed for being placed in fluid connection with a sealable channel 322 of the recipient 301. To that end, the second docking area 104 further comprises a plurality of breakable fastening 138 for docking the recipient 301 to the support 102 during the transfer of the biological material. When the transfer of the biological material is completed, firstly each recipient 301 are sealed by sealing the sealable channel 322. Secondly, the sealed recipients are undocked from the second docking area 104 by breaking the fastening 138. In the present embodiment shown in FIG. 1, each recipient 301 is docked to the second docking area 104 with three fastenings 138.

To transfer the biological material from one sealed chamber 1 to one recipient 301, firstly the platform 106 with five sealed chambers 1 is docked in the slot 105 of the support 102. Five recipients 301 are already fixed to the support 102 and positioned to extend along the axis of the cylinder 133 of the support 102. Secondly, the well plate 115 is positioned onto the slot 105 comprising the platform 106. In this step, the circular wall 125 of the well plate 115 extends along the cylinder surface 134 of the support 102. Then, the cap 114 accommodates the piercing plate 120 and the well plate 115 to permit the insertion of the pin 121 in the first hole 122 of the well plate 115 and in the second hole of the support 102. When the pin 121 is received in the first hole 122 and in the second hole and when the platform 106 is docked into the slot 105, each sharped tip 109 of the piercing plate 120, each additional container 129 of the well plate 115 and each sealed chamber 1 is placed opposite to one inlet port 108 of the support 102 thereby permitting the piercing of each sealed chamber 1.

Thus, the five sealed chambers 1 of the platform 106 can be pierced by the sharped tip 109 to permit the displacement of the biological material in the inlet port 108, said inlet port 108 being in fluid connection with the outlet port 113.

Finally, the transfer device 100 is processed on a centrifuge (not shown) to accelerate the transfer of the biological material by means of centrifugational forces. The rotation of the centrifuge facilitates the displacement of the biological material contained in one sealed chamber 1 to one recipient 301.

The transfer device 200 according to a second embodiment is illustrated in FIG. 2. In the present case, the support 202 is a rectangular plate 206 with a surface 214 manufactured to permit the transfer of the biological material lengthwise with respect to the plate 206, from one end of the plate 206 to the opposite end of the plate 206. The first docking area 203 is located at one end of the plate 206 and designed for receiving the platform 106 containing the biological material. The second docking area 204 is located at the opposite end of the plate 206 with respect to the first docking area 203 so as to receive the recipient 301. The first docking area 203 comprises the slot 205 for accommodating the platform 106. The slot 205 comprises five inlet ports 208, each inlet port 208 being coupled to one sharped tip 209 and to one longitudinal groove 210 in fluid connection with one channel 211. In this embodiment, the piecing means are located underneath each sealed chamber 1 of the platform 106. When the platform 106 is positioned in the slot 205, the sharped tips 209 are able to pierce the sealed chambers 1 so as to permit the displacement of the biological material within the channels 211 via said longitudinal groove 210. Advantageously, the transfer device 200 according to this embodiment might further comprise a lid (not shown) designed for locking the platform 106 into the slot 205, so as to allow the piercing of the sealed chambers 1 of the platform 106 and to assure a contamination-free transfer. Each channel 211 extends lengthwise on the plate 206 in order to connect one inlet port 208 to one purification chamber 212. Advantageously, the channels 211 ensure the fluid connection of one inlet port 208 to one purification chamber 212 depending on the location of the purification chamber 212 comprised in the plate 206. Then, said channel 211 further ensures the fluid connection of said purification chamber 211 to one outlet port 213 manufactured in the second docking area 204. Each outlet port 213 is designed for creating a fluid connection with one recipient 301. As shown in FIG. 2, the support 202 comprises five channels 211, each connecting one inlet port 208 with one outlet port 213. Furthermore, in this second embodiment, each outlet port 213 is further indirectly connected to a pump 215 via one pumping channel 216. The pump 215 permits to suck the biological material through the channels 211 towards the recipients 301 connected to the transfer device 200.

In another embodiment, sample is transferred from the chambers of the PCR disk into the disposable recipients by means of a pressure gradient. This gradient can be established for instance by means of vacuum.

Figure 3:
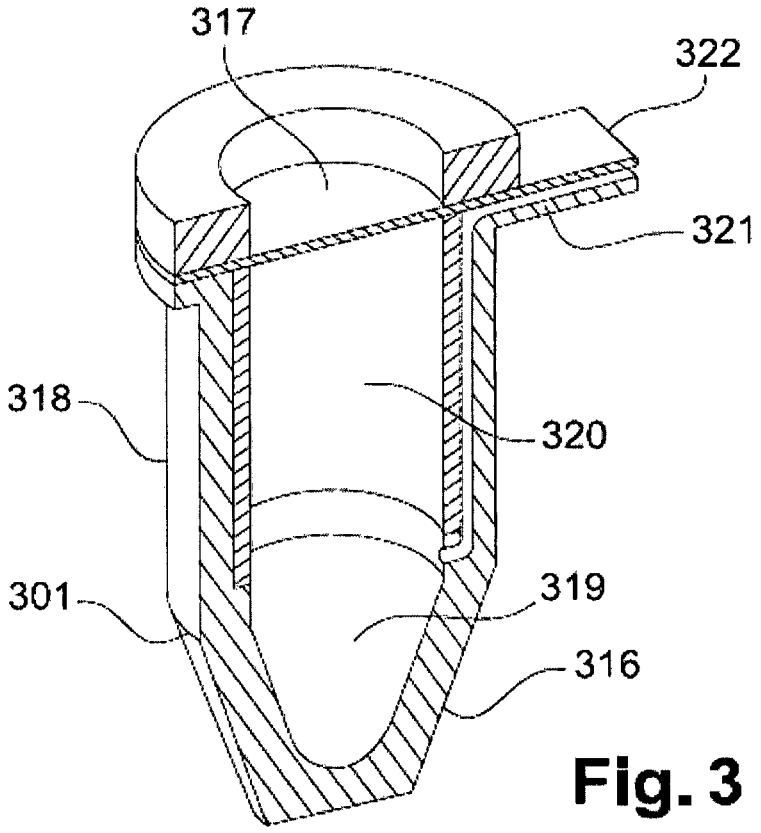
FIG. 3 is a cross section of a perspective view of a recipient according to the present invention to be used with the transfer device according to the present invention.

A recipient 301 according to the invention is designed for being connected to the transfer device 100, 200 according to the present invention, as illustrated in FIG. 3. The recipient 301 comprises a vial 316 with a sealed opening 317. The vial 316 is a conical bottomed tube 318 comprising an enclosed conical portion 319 and a cylindrical portion 320. The sealed opening 317 is designed for being pierced by an instrument that operates the recipient 301. Alternatively, in an embodiment not shown the sealed opening 317 can be an aperture from an Eppendorf tube designed for being operated by an instrument. For instance, once filled with a biological material, each recipient 301 can be placed in a ninety-six wells plate (not shown) in order to perform the required downstream analysis on their content. The vial 316 further comprises docking means for cooperating with the second docking area 104, 204 of the transfer device 100, 200 to dock the recipient 301 to the transfer device 100, 200. Said docking means comprise for example a tab 321 extending from the vial 316 in a direction perpendicular to the axis of the vial 316. The tab 321 presents a shape that is complementary to a part of the shape of the second docking area 104, 204 and comprises at least a sealable channel 322 designed for creating a fluid connection between the inner volume of the recipient 301 and the transfer device 200. Thus, when the recipient 301 is connected to the second docking area 104, 204, the sealable channel 322 is placed in fluid connection with one outlet port 113, 213. The vial 316 can be hermetically closed to isolate the biological material it contains by sealing the sealable channel 322. Preferably, the seal is obtained via heat-sealing, for instance. Besides preventing leakage, once the sealable channel 322 is sealed, the recipient 301 can be separated from the transfer device 100, 200.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

Having described the invention, the following is claimed:

1. A transfer device for contamination free transfer of biological material from a platform including a plurality of sealed chambers having the biological material therein, each of the sealed chambers sealed by a sealing means, to a plurality of recipient members, respectively, wherein said transfer device comprises:

a support member including:

a slot for receiving a platform including plurality of sealed chambers, a plurality of inlet ports in fluid connection with the slot, wherein each of the plurality of inlet ports is configured for respective fluid connection with one of the plurality of sealed chambers of the platform received in the slot, and a plurality of outlet ports, each of the plurality of outlet ports configured for respective fluid connection with one of the plurality of recipient members, wherein each of the plurality of outlet ports is respectively in fluid connection with one of the plurality of inlet ports;

a piercing a piercing member comprised of a plate and a plurality of projections extending from the plate, wherein each of said plurality of projections has a distal tip to respectively pierce the sealing means of one of the plurality of sealed chambers of the platform received within the slot, the plurality of projections respectively aligned with the plurality of inlet ports of the support member;

a well plate including:

a disk member having a surface facing the slot, wherein the disk member maintains the platform within the slot, and a plurality of holes formed in the disk member, each of said plurality of holes respectively aligned with the plurality of inlet ports of the support member; and a cap that joins the piercing member and the well plate the support member.

2. The transfer device according to claim 1, wherein the well plate further comprises a plurality of containers fluidly connectable to the slot, each of said plurality of containers filled with a fluid to be respectively transferred to one of the plurality of sealed chambers of the platform received in the slot.

3. The transfer device according to claim 1, wherein each of said plurality of projections includes a fluid displacement means for respectively displacing the biological material in one of the plurality of sealed chambers of the platform received within the slot.

4. The transfer device according to claim 1, wherein the transfer device further comprises a plurality of purification chambers, each of the plurality of purification chambers respectively in fluid connection with one of said plurality of inlet ports and one of said plurality of outlet ports.

5. The transfer device according to claim 1, wherein the well plate further comprises a plurality of containers respectively extending from the plurality of holes formed in the disk member.

6. The transfer device according to claim 1, wherein said cap, said well plate, and said piercing member cooperate together to form a lid, said lid coupled to said support member.

7. The transfer device according to claim 1, wherein the well plate further comprises a plurality of containers respectively aligned with the plurality of holes formed in the disk member, each of said plurality of containers filled with a fluid to be respectively transferred to one of the plurality of sealed chambers of the platform received in the slot.

8. The transfer device according to claim 3, wherein said fluid displacement means comprises a longitudinal groove.

9. The transfer device according to claim 4, wherein each of said plurality of purification chambers is filled with a filter for purifying the biological material.

10. A kit for the contamination free transfer of biological material from a platform including a plurality of sealed chambers having the biological material therein, each of the sealed chambers sealed by a sealing means, to a plurality of recipient members, the kit comprising:

a transfer device; and the plurality of recipient members configured for connection to the transfer device, each of the plurality of recipient members having a sealable region to respectively receive the biological material from the plurality of sealed chambers, said transfer device comprising:

a support member including:

a slot for receiving platform including a plurality of sealed chambers, a plurality of inlet ports in fluid connection with the slot, wherein each of the plurality of inlet ports is configured for respective fluid connection with one of the plurality of sealed chambers of the platform received in the slot, and a plurality of outlet ports, each of the plurality of outlet ports configured for respective fluid connection with one of the plurality of recipient members, wherein each of the plurality of outlet ports is respectively in connection with one of the plurality of inlet ports;

a piercing a piercing member comprised of a plate and a plurality of projections extending from the plate, wherein each of said plurality of projections has a distal tip to respectively pierce the sealing means of one of the plurality of sealed chambers of the platform received within the slot, the plurality of projections respectively aligned with the plurality of inlet ports of the support member;

a well plate including:

a disk member having a surface facing the slot, wherein the disk member maintains the platform within the slot, and a plurality of holes formed in the disk member, each of said plurality of holes respectively aligned with the plurality of inlet ports of the support member; and a cap that joins the piercing member and the well plate the support member.

11. The kit according the claim 10, wherein the transfer device further comprises a plurality of purification chambers, each of the plurality of purification chambers respectively in fluid connection with one of said plurality of inlet ports and one of said plurality of outlet ports.

12. The kit according to claim 11, wherein each of said plurality of purification chambers is filled with a filter for purifying the biological material.

13. A transfer device in combination with a plurality of recipient members, the transfer device facilitating contamination free transfer of biological material from a platform including a plurality of sealed chambers having the biological material therein, each of the sealed chambers sealed by a sealing means, to the plurality of recipient members, respectively, said combination of the transfer device and the plurality of recipient members comprising:

the transfer device having:

a support member including:

a slot for receiving a platform including a plurality of sealed chambers, a plurality of inlet ports in fluid connection with the slot, wherein each of the plurality of inlet ports is configured for respective fluid connection with one of the plurality of sealed chambers of the platform received in the slot, and a plurality of outlet ports, each of the plurality of outlet ports in respective fluid connection with one of the plurality of recipient members;

wherein each of the plurality of outlet ports is respectively in fluid connection with one of the plurality of inlet ports;

a piercing member comprised of a plate and a plurality of projections extending from the plate, wherein each of said plurality of projections has a distal tip to respectively pierce the sealing means of one of the plurality of the sealed chambers of the platform received within the slot, the plurality of projections respectively aligned with the plurality of inlet ports of the support member;

a well plate including:

a disk member having a surface facing the slot wherein the disk member maintains the platform within the slot, and a plurality of holes formed in the disk member, each of said plurality of holes respectively aligned with the plurality of inlet ports of the support member; and a cap that joins the piercing member and the well plate to the support member, the plurality of recipient members connected to the transfer device, wherein each of the plurality of recipient members has a sealable region to respectively receive the biological material from the plurality of sealed chambers of the platform received in the slot.

14. The combination according to claim 13, wherein the well plate further comprises a plurality of containers fluidly connectable to the slot, each of said plurality of containers filled with a fluid to be respectively transferred to one of the plurality of sealed chambers of the platform received in the slot.

15. The combination according to claim 13, wherein each of said plurality of projections includes a fluid displacement means for displacing the biological material in the plurality of sealed chambers of the platform received within the slot.

16. The combination according to claim 13, wherein the transfer device further comprises a plurality of purification chambers, each of the plurality of purification chambers respectively in fluid connection with one of said plurality of inlet ports and one of said plurality of outlet ports.

17. The combination according to claim 16, wherein each of said plurality of purification chambers is filled with a filter for purifying the biological material.

* * * * *